US007286789B2

(12) United States Patent
Umezawa

(10) Patent No.: US 7,286,789 B2
(45) Date of Patent: Oct. 23, 2007

(54) ROTARY-TYPE IMAGING DEVICE EMPLOYING CORRECTIVE POSITIONING AND TRANSFER VELOCITY CONTROL

(75) Inventor: Hideo Umezawa, Amagasaki (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/270,544

(22) Filed: Nov. 10, 2005

(65) Prior Publication Data

US 2006/0127135 A1 Jun. 15, 2006

(30) Foreign Application Priority Data

Nov. 16, 2004 (JP) ..... P2004-331632

(51) Int. Cl.
*G03G 15/01* (2006.01)

(52) U.S. Cl. ..... 399/227; 399/302

(58) Field of Classification Search ..... 399/227, 399/302

See application file for complete search history.

(56) References Cited

U.S. PATENT DOCUMENTS 5,587,783 A * 12/1996 Nakamura et al. ..... 399/301

FOREIGN PATENT DOCUMENTS

JP 7-064365 3/1995

* cited by examiner

*Primary Examiner*—David M. Gray
*Assistant Examiner*—Bryan Ready
(74) *Attorney, Agent, or Firm*—Squire, Sanders & Dempsey L.L.P.

(57) ABSTRACT

An image forming apparatus has a developing device, in which are integrated a plurality of developers; a photosensitive member, on which are formed toner images by means of the plurality of developers; a transfer member, onto which the toner images of the photosensitive member are transferred; a control portion, which, when any one of the developers among the plurality of developers, having moved with respect to the photosensitive member, has not stopped in a prescribed position, causes corrective movement of the developer to the prescribed position; and, velocity control device, which controls the movement velocity of the transfer member at a lower velocity than a prescribed velocity for a prescribed time interval after the developer has not stopped at the prescribed position.

14 Claims, 4 Drawing Sheets

ROTARY-TYPE IMAGING DEVICE EMPLOYING CORRECTIVE POSITIONING AND TRANSFER VELOCITY CONTROL

BACKGROUND OF THE INVENTION

1. Field of the Invention

This invention relates to an image forming apparatus and image forming method, employing a rotary-type developing device or similar developing device.

This application claims priority from Japanese Patent Application No. 2004-331632, filed on Nov. 16, 2004, the entire contents of which are incorporated herein by reference.

2. Description of Related Art

In a rotary-type image forming apparatus, a rotary-type developing device is used in which four developers, in which are contained toner in each of the colors cyan (CY), magenta (M), yellow (Y), and black (BK), are housed integrally in a single drum, and this developing device is placed in proximity to the circumferential surface of a photosensitive drum; in addition, an endless intermediate transfer belt (transfer member) which undergoes rotating motion contacts the circumferential surface of the photosensitive drum on substantially the side opposite the developing device. By rotating the drum of the developing device by a prescribed angle each time and supplying toner in each of the colors, in order, from each of the developers onto the photosensitive drum, each of the electrostatic latent images formed for each color on the photosensitive drum is developed, in order, as a toner image in each of the colors. Each of the toner images is transferred in superposition and in order from a prescribed transfer position on the intermediate transfer belt accompanying the rotation of the photosensitive drum, and by further transferring each of the toner images onto transfer paper from the intermediate transfer belt, a color image is printed onto the transfer paper (see for example Japanese Unexamined Patent Application, First Publication No. H07-64365).

In such a conventional image forming apparatus, the motor (pulse motor or similar) used to rotate the rotary-type developing device by a prescribed angle each time may fall out of step due to load fluctuations resulting from aging or similar, so that developers may no longer be stopped at regular positions. When developers deviate substantially from normal positions, time is required for corrective rotation control. Furthermore, a prescribed image starting position is stipulated on the endless intermediate transfer belt moving in rotation at a constant speed, in order to indicate the starting position for image formation; if, during corrective rotation control, the image starting position moves past the transfer position, there is a problem in that it is necessary to wait until the intermediate transfer belt rotates one cycle and the image transfer position again reaches the transfer position, so that the printing time is lengthened.

SUMMARY OF THE INVENTION

This invention has as an object the provision of an image forming apparatus and image forming method which prevents unnecessary movement of the transfer member accompanying correction of the halting position of the developing device, and is able to hold printing times to a minimum.

An image forming apparatus of this invention has a developing device, in which are integrated a plurality of developers; a photosensitive member, on which are formed toner images by means of the plurality of developers; a transfer member, onto which the toner images of the photosensitive member are transferred; a control portion, which, when any one of the developers among the plurality of developers, having moved with respect to the photosensitive member, has not stopped in a prescribed position, causes corrective movement of the developer to the prescribed position; and, velocity control device, which controls the movement velocity of the transfer member at a lower velocity than a prescribed velocity for a prescribed time interval after the developer has not stopped at the prescribed position.

An image forming method of this invention is a method of image formation in which toner images on a photosensitive member, formed by means of a plurality of developers, are transferred onto a transfer member, and is characterized in that, when any one of the developers among the plurality of developers, having moved with respect to the photosensitive member, has not stopped in a prescribed position, the developer is caused to undergo corrective movement to the prescribed position, and in that, for a prescribed interval of time after the developer has not stopped at the prescribed position, the velocity of the transfer member is controlled at a lower velocity than a prescribed velocity.

By means of this invention, unnecessary movement of the transfer member accompanying correction of the stopped position of the developing device can be prevented, and the printing time can he held to a minimum.

DETAILED DESCRIPTION OF THE INVENTION

Below, an embodiment of the invention is explained, together with the drawings.

Figure 1:
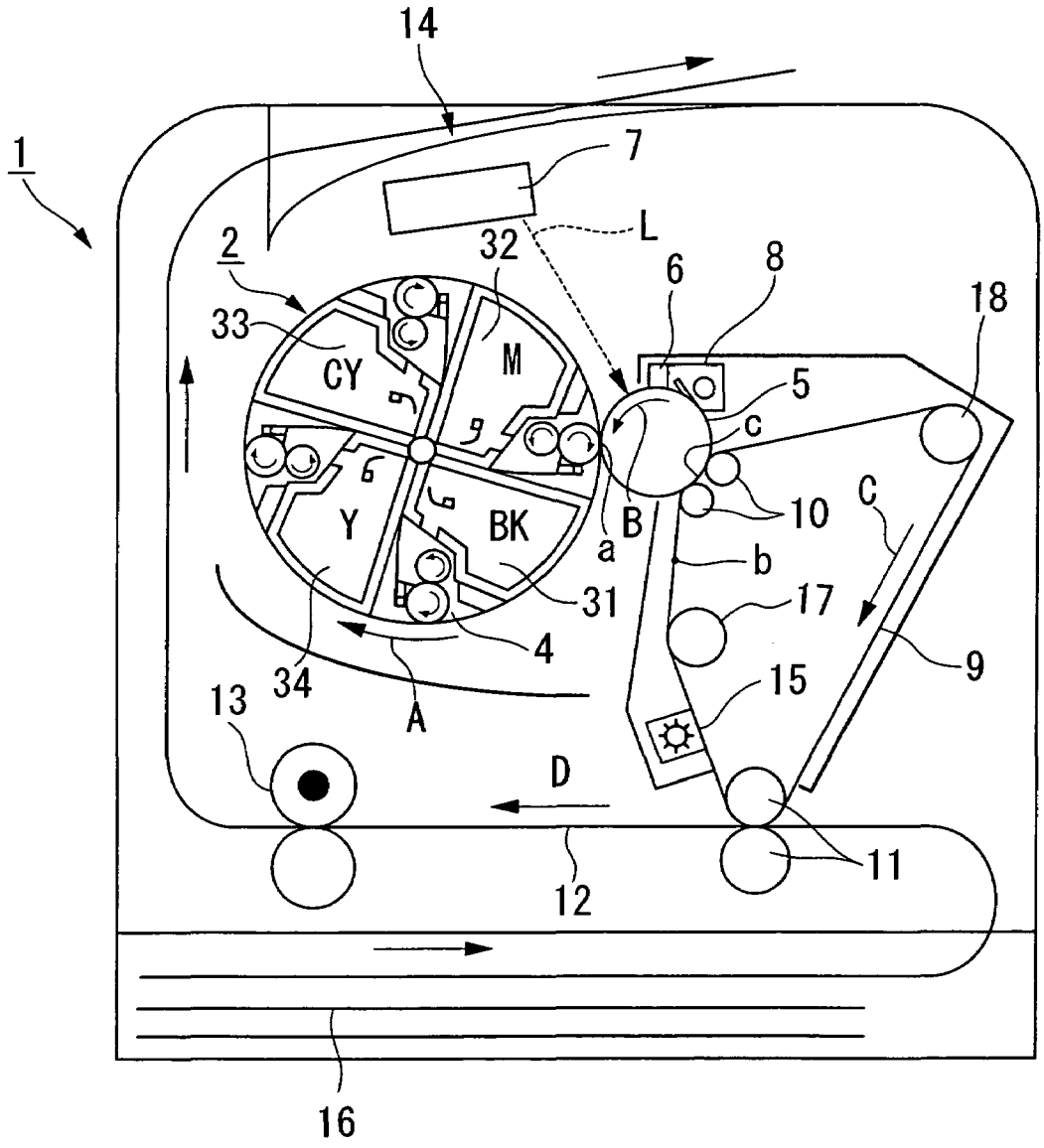
FIG. 1 shows the configuration of the image forming apparatus of an embodiment of the invention.

FIG. 1 shows the configuration of the image forming apparatus of an embodiment of the invention.

In FIG. 1, reference symbol 1 denotes the entire image forming apparatus. Reference symbol 2 denotes a rotary-type developing device (hereafter called "developing device 2"); reference symbols 31, 32, 33, 34 denote developers; reference symbol 4 denotes a drum; reference symbol 5 denotes a photosensitive drum; reference symbol 6 denotes a charger; reference symbol 7 denotes an optical unit; reference symbol 8 denotes a cleaner; reference symbol 9 denotes an intermediate transfer belt; reference symbol 10 denotes a primary transfer roller; reference symbol 11 denotes a secondary transfer roller; reference symbol 12 denotes transfer paper; reference symbol 13 denotes a fuser; reference symbol 14 denotes a paper eject portion; reference symbol 15 denotes a cleaner; reference symbol 16 denotes a paper supply portion; reference symbol 17 denotes a driving roller; and reference symbol 18 denotes a guide roller.

As shown in FIG. 1, the developing device 2 is configured with four developers 31, 32, 33, 34 housed integrally in a single, freely rotatable drum 4. The developers 31 to 34 have cartridges in which is provided toner in one of the colors BK, Y, CY, and M. A switching control portion, described below causes the drum 4 in this developing device 2 to be rotated in the direction of the arrow A by a prescribed angle each time, so that the toner supply rollers corresponding to each of the developers 31 to 34 are switched one at a time, and are placed in proximity to position "a" on the circumferential surface of the photosensitive drum 5. The photosensitive drum 5 is rotated at a prescribed velocity in the direction of the arrow B, and is charged by the charger 6. The circumferential surface of the photosensitive drum 5 is irradiated with and scanned by laser light L from the optical unit 7 according to image signals, and electrostatic latent images in each of the colors are formed, in order, on the circumferential surface. The intermediate transfer belt 9 is stretched in a loop shape by the rollers 10, 11, 17, 18, and is moved in rotation in the direction of the arrow C by the driving roller 17. A prescribed image leading position "b" indicating the starting position for image formation is stipulated on the intermediate transfer belt 9; this image leading position "b" is detected by an image leading position sensor, described below.

In such a configuration, the drum 4 of the developing device 2 is rotated by a prescribed angle each time, so that for example the developer 32 is brought into proximity with the circumferential surface of the photosensitive drum 5 at position "a". When magenta toner is supplied onto the photosensitive drum 5 from the toner supply roller of the developer 32, an electrostatic latent image is developed as a magenta toner image. This toner image moves accompanying rotation of the photosensitive drum 5, and at the transfer position "c" is transferred by the primary transfer roller 10 onto the intermediate transfer belt 9 from the image leading position "b". In this way, toner images in each color are superposed in order onto the intermediate transfer belt 9.

On the other hand, transfer paper 12, supplied with a certain timing from the paper supply portion 16, advances in the direction of the arrow D. By transferring the toner images, superposed in each color on the intermediate transfer belt 9, onto the transfer paper 12 by means of the second transfer roller 11, a color image is printed onto the transfer paper 12. After fusing of this color image by the fuser 13, the transfer paper 12 with printed image is ejected from the paper eject portion 14. Also, after the toner image on the photosensitive drum 5 has been transferred onto the intermediate transfer belt 9, the residual toner is removed by the cleaner 8, and after the toner image on the intermediate transfer belt 9 has been transferred onto the transfer paper 12, the residual toner is removed by the cleaner 15.

In a case in which, due to aging or other causes, the pulse motor causes rotation of the developing device 2 or another motor has fallen out of step and the developers 31 to 34 do not stop at the correct position "a", corrective rotation control is performed, in which the motor is again driven to cause the developers 31 to 34 to stop at position "a". While this control is being performed, if the image leading position "b" on the intermediate transfer belt 9 passes the transfer position "c", then it is necessary to wait until the intermediate transfer belt 9 rotates one cycle and the image leading position "b" reaches the transfer position "c". In this embodiment, such a wait time is eliminated, and the printing time is shortened to the extent possible.

Figure 2:
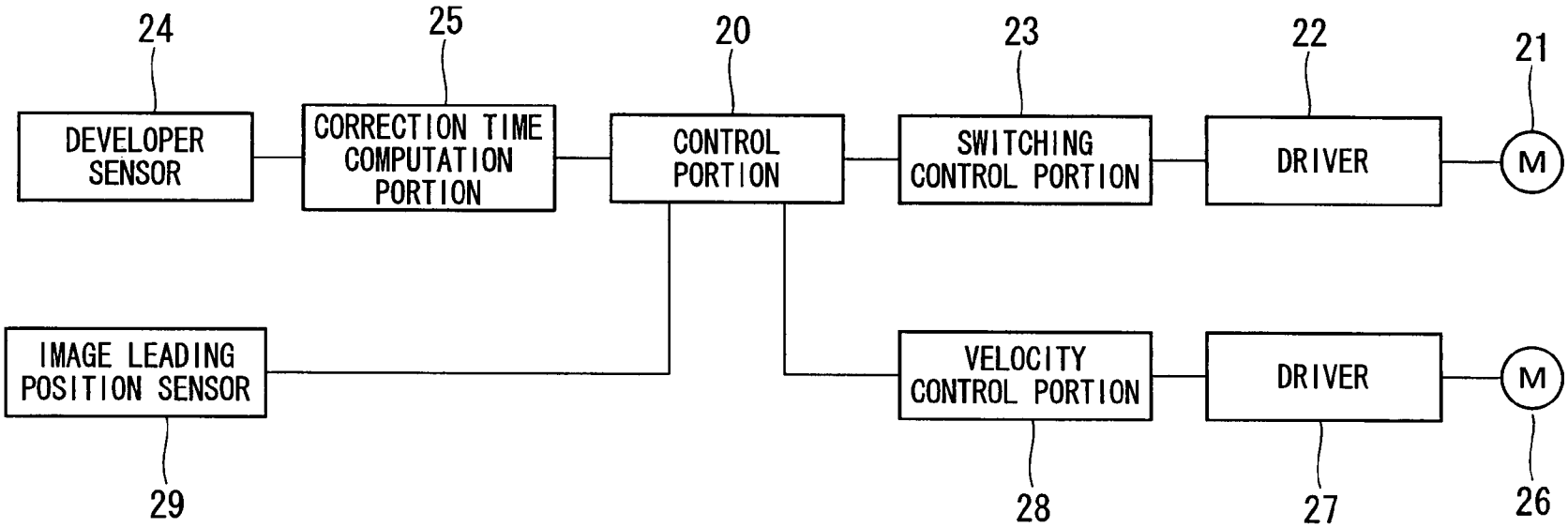
FIG. 2 is a block diagram showing the configuration of the control device of an image forming apparatus.

FIG. 2 is a block diagram showing the configuration of the control device of the image forming apparatus 1.

In FIG. 2, reference symbol 20 denotes the control portion, which employs a CPU or similar to control the entire apparatus; reference symbol 21 denotes a pulse motor or other motor which rotates the drum 4 of the developing device 2; reference symbol 22 denotes a driver which drives the motor 21; and reference symbol 23 denotes a switching control portion which controls rotation of the motor 21 by a prescribed angle each time, and switches, in order, the developers 31 to 34. In actuality, the switching control portion 23 rotates the drum 4 of the developing device 2 by a prescribed angle each time by causing the output shaft of the motor 21 to rotate at a fixed velocity for a prescribed amount of time each time (or, by applying a prescribed number of driving pulses each time to the motor 21).

Reference symbol 24 denotes a developer sensor, which detects the position of the developers 31 to 34 of the developing device 2 in the vicinity of position "a"; reference symbol 25 denotes a correction time computation portion, which computes the time required for corrective rotation control; reference symbol 26 denotes a motor which rotates the driving roller 17 of the intermediate transfer belt 9; reference symbol 27 denotes a driver which drives the motor 26; reference symbol 28 denotes a velocity control portion, which executes velocity control of the motor 26; and reference symbol 29 denotes an image leading position sensor, which detects the image leading position "b" on the intermediate transfer belt 9. Portions relating to the motor which drives the photosensitive drum 5 are omitted from the drawing.

Next, the operation of the image forming apparatus 1 with the above-described configuration is explained.

In the normal state, the intermediate transfer belt velocity control mode is in the cancelled state, and during the period of corrective rotation control, the velocity of the intermediate transfer belt 9 is slower than a normal prescribed velocity. As a result, while performing corrective rotation control, advance of the image leading position "b" beyond the transfer position "c" is prevented. When the deviation of the stopped position of the developers 31 to 34 from the regular position "a" is large, or when the image leading position "b" is in proximity to the transfer position "c", upon corrective rotation control the velocity of the intermediate transfer belt 9 may be made substantially slower than the prescribed velocity or may be stopped, or other appropriate velocity control may be performed.

Furthermore, when the frequency of occurrence of corrective rotation control exceeds a prescribed threshold, intermediate transfer belt velocity control mode is entered, and subsequently the velocity of the intermediate transfer belt 9 becomes slower than the normal prescribed velocity, regardless of whether corrective rotation control is being performed. At this time, during the time interval excluding the interval from the start of transfer of the toner image beginning from the image leading position until the transfer ends, the velocity of the intermediate transfer belt is made slower than the normal prescribed velocity.

More specifically, in FIG. 1 and FIG. 2, if while in the normal state the stopped position of the developers 31 to 34 as detected by the developer sensor 24 is the regular position "a", then the switching control portion 23 executes rotation control (switching control) each prescribed length of time of the motor 21, via the driver 22, such that each of the developers 31 to 34 stops in order at position "a". As a result of control of the motor 26 at the prescribed velocity by the velocity control portion 28 through the driver 27, the intermediate transfer belt 9 moves in a loop at the prescribed velocity.

When the stopped position of the developers 31 to 34, as detected by the developer sensor 24, is shifted from the regular position "a", the control portion 20 issues an instruction to the switching control portion 23 for corrective rotation control. The correction time computation portion 25 determines the time required for corrective rotation control, according to the amount of shift of the stopped position of the developers 31 to 34 from the regular position "a". In addition to this computed time, the control portion 20 determines the velocity of the intermediate transfer belt 9 such that the image leading position on the intermediate transfer belt 9 and the leading position of the developed toner image are synchronized, based on the time of arrival of the developed toner on the photosensitive drum 5 at the transfer position and on other parameters, and executes velocity control of the intermediate transfer belt 9 accordingly via the velocity control portion 28.

Here, the time required for corrective rotation control is stored in memory in the control portion 20. When corrective rotation control is again performed, the control portion 20 compares the time required for control with the required time stored in memory, and stores the longer time in memory. Also, when the frequency of occurrence of corrective rotation control is equal to or greater than a prescribed value, the control portion 20 makes a transition into intermediate transfer belt velocity control mode. In intermediate transfer belt velocity control mode, the velocity control portion 28 executes control to cause the rotation velocity of the motor 26 to be slower than the prescribed velocity in the normal state, regardless of whether corrective rotation control is being performed. At this time the intermediate transfer belt velocity is determined, based on the longest time required for corrective rotation control as stored in memory, such that corrective rotation control ends before the image leading position on the intermediate transfer belt reaches the transfer position. Further, the velocity control portion 28 reduces the velocity of the intermediate transfer belt to below the normal prescribed velocity during the time interval excluding the interval from the start of transfer of the toner image beginning from the image leading position until the transfer ends. Hence during the time period from the start to the end of toner image transfer, the velocity of the intermediate transfer belt is always constant, and there is no need to alter the transfer conditions or other parameters.

Upon corrective rotation control, the switching control portion 23 again drives the motor 21 to stop the developers 31 to 34 at the regular position "a". At this time the intermediate transfer belt velocity is determined based on the longest time required for corrective rotation control as stored in memory, so that the corrective rotation control ends before the image leading position "b" on the intermediate transfer belt 9 reaches the transfer position "c", with the developer 31 to 34 stopped at the regular position "a". When the shift between the stopped position of the developer 31 to 34 and the regular position "a" is large, or when the image leading position "b" is in proximity to the transfer position "c" or similar, the velocity of the intermediate transfer belt 9 may be made substantially slower than the prescribed velocity or may be stopped, or other appropriate velocity control may be performed.

Figure 3:
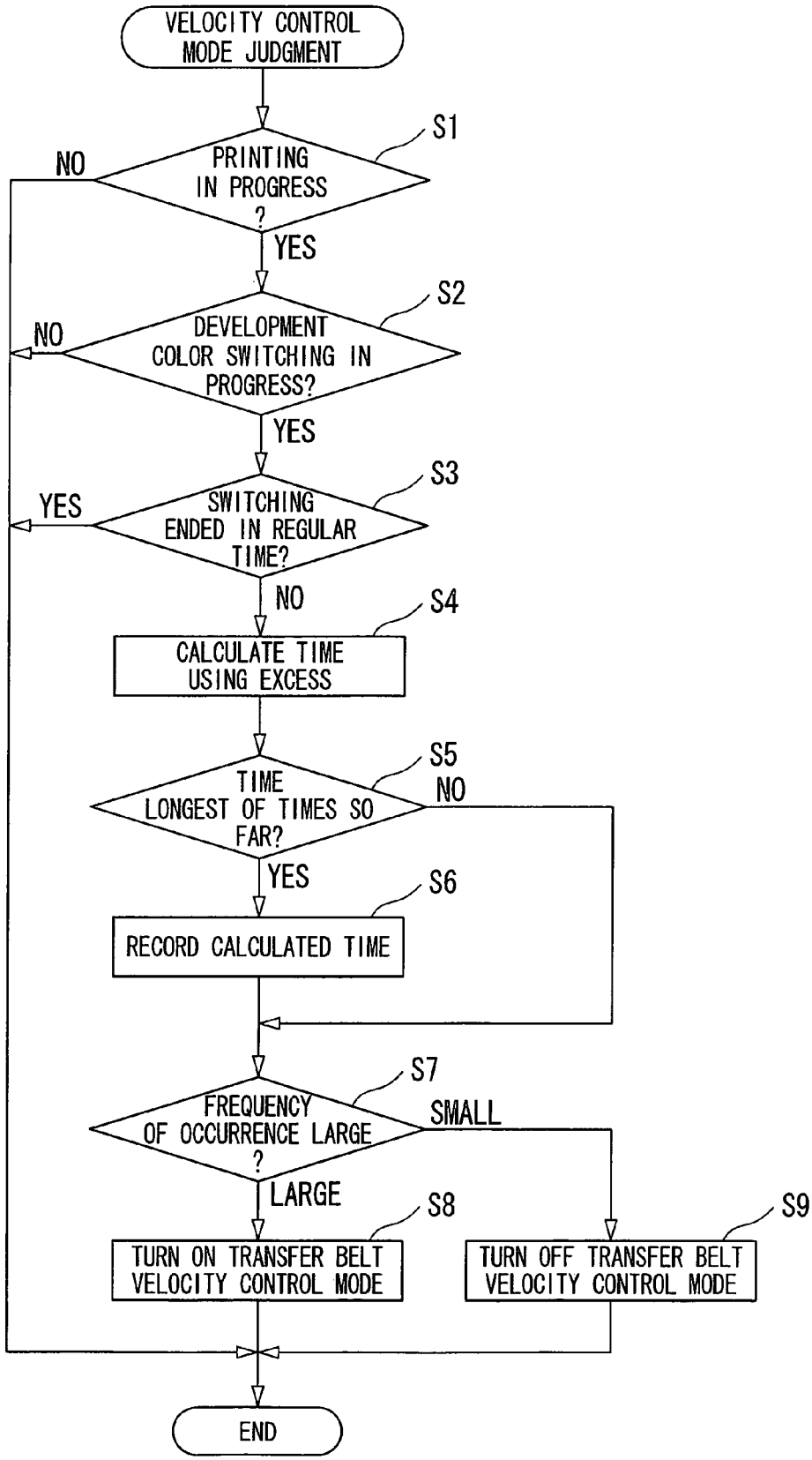
FIG. 3 is a flowchart for judging whether to enter a velocity control mode for the intermediate transfer belt.

FIG. 3 is a flowchart for judging whether to enter the intermediate transfer belt velocity control mode.

In FIG. 3, the control portion 20 judges whether printing is in progress (step S1), and if printing is not in progress, processing ends. If printing is in progress, the control portion 20 judges whether switching of the developers 31 to 34 is being performed (step S2), and if switching is not being performed, processing ends. If switching is being performed, the control portion 20 judges whether switching of the developers 31 to 34 has ended at the regular time (step S3). If the stopped position detected by the developer sensor 24 coincides with the regular stopped position "a", the switching has ended at the regular time, and in this case processing ends. If the two do not coincide, the control portion 20 causes the correction time computation portion 25 to determine the time required for repeated corrective rotation to the regular position "a" (step S4).

Figure 4:
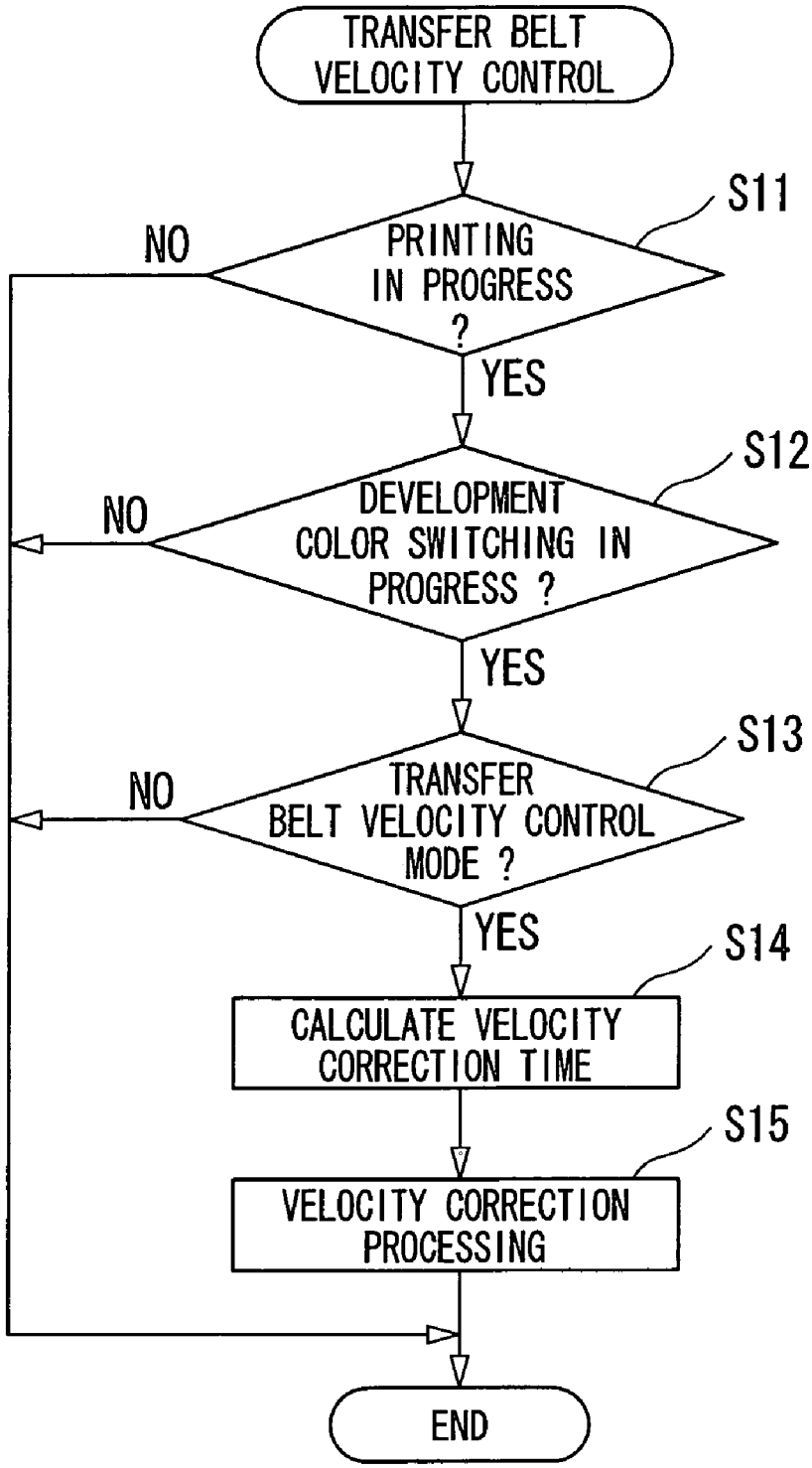
FIG. 4 is a flowchart explaining operation of an intermediate transfer belt velocity control mode.

Next, the control portion 20 judges whether the determined time is the longest up to that point (step S5), and if the longest, stores this time in memory (step S6). After storage, or if the time is not the longest time, the control portion determines the frequency of occurrence, indicating the number of times, in a prescribed length of time, that switching has not ended at the regular time (step S7); if the frequency of occurrence is equal to or greater than a fixed value, a transition is made to intermediate transfer belt velocity control mode (step S8), and if the frequency of occurrence is smaller than the fixed value, the intermediate transfer belt velocity control mode is cancelled (step S9). FIG. 4 is a flowchart explaining operation of the intermediate transfer belt velocity control mode.

In FIG. 4, the control portion 20 judges whether printing is in progress (step S11), and if printing is not in progress, processing ends. If printing is in progress, the control portion 20 judges whether switching of the developers 31 to 34 is being performed (step S12), and if switching is not being performed, processing ends. If switching is being performed, the control portion 20 judges whether the intermediate transfer belt velocity control mode is turned on (step S13), and if not turned on, processing ends. If turned on, the control portion 20 calculates the correction time (step S14), and performs control to slow the velocity of the intermediate transfer belt 9 (step S15).

By means of this embodiment, when at the time of switching of the developers 31 to 34 of the developing device 2 the motor 21 driving this developing device 2 has fallen out of step and rotation correction control is being performed, the velocity of the intermediate transfer belt 9 is made slower than normal, so that advance of the image leading position "b" beyond the transfer position "c" during rotation correction control is prevented, and so printing time can be held to a minimum even when the motor 21 has fallen out of step.

In this embodiment, an example which employs a rotary-type developing device has been explained; however, this invention can be applied not only to a rotary-type device, but to any developing device employing a method in which a plurality of developers are integrated and the developers are brought into proximity with a photosensitive drum in order to perform development.

What is claimed is:

1. An imaging device comprising:

a developing device, which includes a drum in which a plurality of developers is integrated;

a photosensitive member, on which toner images are formed by means of said plurality of developers, wherein said drum is rotated by a prescribed angle each time so that each of said developers is positioned relative to said photosensitive member;

a transfer member, onto which said toner images of said photosensitive member are transferred;

control portion, which corrects the positioning of each of said developers at a correct position relative to said photosensitive member;

a velocity control device, which controls the movement velocity of said transfer member at a lower velocity than a prescribed velocity during at least a time interval of said corrective positioning; and a correction time computation portion, which computes the time required for corrective positioning based on a shift amount between a stopping position of the developing device and the correct position.

2. The imaging device according to claim 1, wherein said velocity control device executes control to reduce the velocity of said transfer member below said prescribed velocity during a time interval which excludes the interval from the start of transfer of said toner image until the transfer ends.

3. The imaging device according to claim 2, wherein said velocity control device executes control to reduce the movement velocity of said transfer member below said prescribed velocity during the time interval of said corrective positioning.

4. The imaging device according to claim 2, wherein, when the frequency of occurrence of said corrective positioning is equal to or greater than a prescribed value, said velocity control device makes a transition to a mode of controlling the movement velocity of said transfer member to be lower than said prescribed velocity, regardless of whether said corrective positioning is being performed.

5. The imaging device according to claim 4, wherein, in said mode, said velocity control device executes control of the movement velocity of said transfer member based on the longest time required for said corrective positioning.

6. An imaging method in which toner images on a photosensitive member, formed by means of a plurality of developers, are transferred onto a transfer member, the image forming method comprising:

rotating a drum, in which are integrated a plurality of developers, by a prescribed angle each time so that each of said developers is positioned relative to said photosensitive member;

correctively positioning each of said developers at a correct position relative to said photosensitive member;

controlling velocity of said transfer member at a lower velocity than a prescribed velocity during at least a time interval of said corrective positioning; and computing the time required for corrective positioning based on a shift amount between a stopping position of the developing device and the correct position.

7. The imaging method according to claim 6, wherein control is executed to reduce the velocity of said transfer member below said prescribed velocity during a time interval which excludes the interval from the start of transfer of said toner image until the transfer ends.

8. The imaging method according to claim 7, wherein control is executed to reduce the movement velocity of said transfer member below said prescribed velocity during the time interval of said corrective positioning.

9. The imaging method according to claim 7, wherein, when the frequency of occurrence of said corrective positioning is equal to or greater than a prescribed value, a transition is made to a mode of controlling the movement velocity of said transfer member to be lower than said prescribed velocity, regardless of whether said corrective positioning is being performed.

10. The imaging method according to claim 9, wherein, in said mode, control of the movement velocity of said transfer member is executed based on the longest time required for said corrective positioning.

11. The imaging device according to claim 1, wherein the movement velocity of the transfer member is determined based at least on a computed result of the correction time computation portion and on a time of arrival of a toner image on the photosensitive drum at a transfer position for transfer to the transfer member.

12. The imaging method according to claim 6, wherein the movement velocity of the transfer member is determined based at least on a computed result of a correction time computation portion and on the time of arrival of a toner image on the photosensitive drum at a transfer position for transfer to the transfer member.

13. An imaging device comprising:

a developing device, which includes a drum in which a plurality of developers is integrated;

a photosensitive member, on which toner images are formed by means of said plurality of developers, wherein said drum is rotated by a prescribed angle each time so that each of said developers is positioned relative to said photosensitive member;

a transfer member, onto which said toner images of said photosensitive member are transferred;

control portion, which corrects the positioning of each of said developers at a correct position relative to said photosensitive member; and a velocity control device, which controls the movement velocity of said transfer member at a lower velocity than a prescribed velocity during at least a time interval of said corrective positioning, wherein said velocity control device executes control to reduce the velocity of said transfer member below said prescribed velocity during a time interval which excludes the interval from the start of transfer of said toner image until the transfer ends, and wherein, when the frequency of occurrence of said corrective positioning is equal to or greater than a prescribed value, said velocity control device makes a transition to a mode of controlling the movement velocity of said transfer member to be lower than said prescribed velocity, regardless of whether said corrective positioning is being performed.

14. An imaging method in which toner images on a photosensitive member, formed by means of a plurality of developers, are transferred onto a transfer member, the image forming method comprising:

rotating a drum, in which are integrated a plurality of developers, by a prescribed angle each time so that each of said developers is positioned relative to said photosensitive member;

correctively positioning each of said developers at a correct position relative to said photosensitive member; and controlling velocity of said transfer member at a lower velocity than a prescribed velocity during at least a time interval of said corrective positioning, wherein control is executed to reduce the velocity of said transfer member below said prescribed velocity during a time interval which excludes the interval from the start of transfer of said toner image until the transfer ends, and wherein, when the frequency of occurrence of said corrective positioning is equal to or greater than a prescribed value, a transition is made to a mode of controlling the movement velocity of said transfer member to be lower than said prescribed velocity, regardless of whether said corrective positioning is being performed.

* * * * *